United States Patent [19]

Arnemann

[11] Patent Number: 4,804,024

[45] Date of Patent: Feb. 14, 1989

[54] APPARATUS FOR FILLING CONTAINERS WITH A FLOWABLE MEDIUM

[76] Inventor: Gerhard Arnemann, Am Krönrey 11, D-2083 Halstenbek, Fed. Rep. of Germany

[21] Appl. No.: 72,466

[22] Filed: Jul. 10, 1987

[30] Foreign Application Priority Data

May 13, 1987 [EP] European Pat. Off. ..... 87106911.8

[51] Int. Cl.[4] ..... B65B 7/28; B67C 3/30

[52] U.S. Cl. ..... 141/165; 141/83; 141/95; 141/168; 141/163; 141/237; 141/178; 53/381 A; 53/287

[58] Field of Search ..... 53/381 A, 381 R, 468, 53/467, 492, 287; 141/83, 98, 129, 163, 165, 167, 168, 171, 177, 172, 178, 181, 312

[56] References Cited

U.S. PATENT DOCUMENTS

| | | | |
|---|---|---|---|
| 3,610,398 | 10/1971 | Rice | 141/168 X |
| 3,633,765 | 1/1972 | Bennett et al. | 141/171 X |
| 3,707,174 | 12/1976 | Lewis | 141/165 X |
| 3,990,212 | 11/1976 | Flodin | 141/83 X |
| 4,010,594 | 3/1977 | Boyd | 141/83 X |
| 4,018,026 | 4/1977 | Kamisaka et al. | 141/165 X |
| 4,024,621 | 5/1977 | Hodgetts | 53/381 A X |
| 4,091,597 | 5/1978 | Sanderson et al. | 141/171 X |
| 4,193,430 | 3/1980 | James, Jr. et al. | 141/12 X |
| 4,275,775 | 6/1981 | Egli | 141/83 |
| 4,337,802 | 7/1982 | Kennedy et al. | 141/83 X |
| 4,363,338 | 12/1982 | Brown | 141/2 |
| 4,494,583 | 1/1985 | Reeves, Jr. et al. | 141/83 |
| 4,520,853 | 6/1985 | Niese et al. | 141/168 |
| 4,620,411 | 11/1986 | Schieser et al. | 53/381 A X |
| 4,628,972 | 12/1986 | LaRochelle | 141/98 X |
| 4,676,285 | 6/1987 | Schieser et al. | 141/168 X |

FOREIGN PATENT DOCUMENTS

| | | | |
|---|---|---|---|
| 2062884 | 8/1972 | Fed. Rep. of Germany | 141/165 |

*Primary Examiner*—Henry J. Recla
*Assistant Examiner*—Ernest G. Cusick
*Attorney, Agent, or Firm*—Stanger, Michaelson, Reynolds, Spivak & Tobia

[57] ABSTRACT

In the fill apparatus, a container feed belt with a lifting frame at the entry end includes container supporting and centering pulleys for displacing the empty container in the horizontal direction by means of alignment pulleys engaging the container rim in order to rotate the container about its longitudinal axis. A first work station arranged above the container includes a rotary disk rotatable about a vertical axis with circumferentially arranged devices participating in the rotary movement of the rotary disk for unscrewing the screw plugs closing the container fill opening, measuring the moisture content and seeking the container's bunghole. A second work station following the first work station includes a filling device. A third work station having a filling device and a following third work station includes devices for screwing the screw plugs on to the container openings and for mounting safety caps. Simultaneous use of the three work stations makes it possible to simultaneously deal with three containers.

15 Claims, 9 Drawing Sheets

APPARATUS FOR FILLING CONTAINERS WITH A FLOWABLE MEDIUM

BACKGROUND OF INVENTION

The invention relates to an apparatus for filling containers with a liquid or solid flowing medium, and particularly for filling drums or barrels sealed with screw plugs or other plugs, especially screw plugs covered by slipped-on safety caps.

Various apparatuses are known for simultaneously filling receptacles, such as containers, drums, packs or the like, with liquid or flowable solid media.

European Patent Specification EP-A-No.-0 105 197 discloses such a filling apparatus, which includes a pipe system with a feed pump for supplying the medium to be filled, and filling valves connected by means of supply lines above the receptacle to be filled. Each supply line leading to the filling valves includes a volume changer with an impeller arranged in its interior and rotated by the medium flowing to the particular filling valve. The impellers of all the volume chambers are rigidly interconnected by means of a mechanical shaft connected to a breaking apparatus controllable by means of a system pressure-dependent control device. To control the filling valves a two-stage pneumatic control cylinder is directly connected with at least one filling valve and is connected to the other filling valves by means of an adjusting device. A control member responds to the weight of the filled medium by means of a balance associated with one of the filling valves and is connected to the control cylinder. Such a filling apparatus makes it possible to simultaneously fill several receptacles, while it is only necessary to measure and monitor the filling volume or weight of a single receptacle.

U.S. Pat. No. 3,548,891 discloses a plant for simultaneously filling several receptacles, but using dosing and filling apparatus in a number corresponding to the number of containers to be filled, with an individual filling arrangement associated with each of the containers to be filled. The filling connections used in this plant make it possible to fill individual containers in accordance with the filling volume. This is made possible by a filling arrangement associated wtih each individual container. However, in the case of this filling arrangement neither the filling volume, nor the filling weight of an individual container is measured and monitored, so that the filling of the containers is not controlled by means of the filling volume or weight of an individual container. In this filling plant, the filling volume or weight of each individual container is monitored and used for controlling the filling arrangement.

U.S. Pat. No. 3,205,920 discloses a filling apparatus making it possible to pour liquids into containers which are moved past several filling valves. The containers to be filled travel on a conveyor belt, whose forward movement stops if the number of containers corresponding to the number of filling valves is located under the discharge openings of the latter. At this instant a link motion simultaneously places all the filling valves on the openings of the containers to be filled and pumps simultaneously supply the filling valves with that liquid quantity which is to fill containers. In order to ensure uniform setting of the filling valves onto the container openings, all the filling valves are fixed to a supporting beam, which travels in vertical guides. The link motion allows the supporting beam to move the filling valves up and down. The filling valves are connected to the pump by means of flexible hose line. Once again, this filling apparatus simultaneously fills all the containers with liquid using filling valves which simultaneously perform dosing.

Drums intended to be filled with liquids are, as is known, supplied with screwed down plugs. It is therefore necessary to remove the latter and then screw them down again after filling. Thus, the drums must be precisely aligned on the feed belt or the like of the filling arrangement. Otherwise there is a risk that the filling material will flow down the drum and not into the bunghole.

Disclosure of an apparatus for closing the fill opening of a drum or the like with a device for inserting and fixing a plug in the opening appears in DE-A-No.-1,817,237. Here a closing or sealing apparatus includes both a device for inserting the plug and also a position determining device fitted and spaced so that they can freely move up and down, as well as in accordance with polar co-ordinates with respect to a fixed point in a plane at right angles to the upwardly and downwardly directed movement. In addition, a gripping arrangement prevents free movement of inserting device and the positioning device. When the gripping arrangement prevents the free movement of the inserting and positioning devices a drive arrangement is able to move the two devices, but only linearly and in forced manner over a distance corresponding to the spacing between the two devices. This closing device has very large dimensions.

U.S. Pat. No. 2,731,185 discloses a plug screw-in device with a centering and screw-in head, which includes an outer centering ring and a screw-in head displaceable therein counter to spring tension. A drive shaft connects the head with angularly movable joints to a drive. The centering ring is constructed and profiled such that on screwing a plug into the bunghole of the drum it is supported on the upper circumferential rim of the bunghole connection and therefore is adapted to the dimensions and diameter of the bunghole connection.

European Specification EP-A-No.-0 065 180 discloses a plug screw-in device for drums having a centering and screw-in head, comprising an outer centering ring and a screwhead located in its interior and displaceable against spring tension and which is connected to its drive apparatus by means of a drive shaft having an angularly movable joint. This plug screw-in device includes a supporting frame and an upper mounting plate and a lower mounting plate on which is arranged a centering plate, which is provided with a cross-shaped opening and whose inner wall surface bounding the opening tapers conically towards the centering and screw-in head and passes at the bottom into a vertical wall section. The internal diameter of the recess defined by the wall section is larger than the diameter of the drive shaft. In the opening is placed a correspondingly profiled molded or shaped body with an outer wall surface tapering conically in the direction of the centering rings supported on the drum cover plate during the plug centering rings supported on the drum cover plate during the plug and screw-in process and is connected by a portion located on the plate to a guide plate. The latter is held on at least three guide bolts fixed to the lower mounting plate of the supporting frame so as to be longitudinally displaceable and pivotable against the tension of springs. The drive shaft includes a shaft part connected to the drive apparatus and a shaft part carrying the screw-in head, the two shaft parts being interconnected by means of a universal joint.

All the filling plants operate in the same way, namely following the alignment of the container to be filled by means of a screw-in arrangement, the screw plug is screwed out of the container filling opening, picked up and placed on a conveyor belt, which runs parallel to the feed path of the container to be filled. The screw plugs removed from the screw-in apparatus and placed on the conveyor belt are brought into a new position parallel to the feed movement of the containers to be filled, in which the screw plug is screwed into the fill opening of the filled container and the screw in-in apparatus for the screw plugs can also participate in this forward or advance movement if no second screw-in apparatus is provided. When the screw plug has been unscrewed, then the empty container is supplied on a conveying apparatus to a filling station and stays therein until the container has been filled with the corresponding filling material. The filled container then passes into the screw plug screw-in position, where the screw-in apparatus is kept ready. In this position, it is simultaneously possible to supply safety caps, which of corresponding mechanism mounts on the screw plug screwed into the fill opening of the filled container. In such a filling plant there are three work cycles, namely in the first cycle the drum is aligned and the screw plug is unscrewed from the filling opening. Following a further advance of the thus prepared container, in the second work cycle the container is filled. Followed a further advance of the filled container, in a third work cycle the fill opening is sealed by means of a screw plug and optionally the safety cap is fitted. A thus contracted and functioning filling plant has relatively large dimensions, even though satisfactory working speeds are achieved. In addition, the operating efficiency of such a filling plant is dependent on the filling time and the number of work cycles. Furthermore, there is no need in the case of such filling plants to align the containers with the screw-in apparatus and the filling apparatus in a very accurate manner. An extremely accurate alignment or orientation of the containers is necessary only for fitting the safety cap on the already screwed in screw plugs.

SUMMARY OF THE INVENTION

The invention solves the problem of providing a filling arrangement for containers, particularly drums, in which the removal of the plug, the measurement of the moisture, the filling of the empty container, the insertion of the plug into the filling openings of the filled containers and the fitting of the safety caps can be performed at a high output rate and efficiency.

According to the invention the filling apparatus is arranged in a machine frame and comprises (a) a horizontal conveyor belt for the containers having a length which is at least twice the diameter of a container, the conveyor belt comprising two spaced endless chain belts, driven in revolving manner and whose upper sides guide the containers.

(b) a apparatus for slightly raising the individual containers from the chain belts arranged on the feed side between the upper sides of the two chain belts, the apparatus comprising (b1) a hydraulically, pneumatically or electromotively driven raisable and lowerable lifting frame engaging the individual containers on their circumferential laterally projecting edge in the region between the two chain belts, (b2) at least three container supporting and centering pulleys arranged in raisable and lowerable manner together with the lifting frame between the upper sides of the two chain belts on a circular line with a diameter at least corresponding to the container diameter with bearing axis or spindles running radially to the vertical, approximately central container rotation axis, the supporting and centering pulleys being freely displaceable on their bearing axes in the longitudinal direction thereof and being automatically centering towards the centre of the circular line, so that a container standing on the supporting and centering pulleys is horizontally displaceable in all directions and (b3) alignment pulleys with vertical bearing axes or spindles arranged in the circumferential region of the container standing on the supporting and centering pulleys and engageable on the container outer wall surface, or on the circumferential rim of the container base plate, three alignment pulleys being provided, whereof at least on alignment pulley is driven in rotary manner by means of a drive mechanism, which simultaneously serves as a fixed, lateral boundary stop for the container, while the two other alignment pulleys facing the first alignment pulley are arranged in overhung manner on their bearing spindles and preferably all three alignment pulleys can be swung out of their container outer wall surface engagement position, (c) a first work station with a plug unscrewing means for the screw plugs with a bunghole seeking device and with a moisture measuring probe constructed as a centering means, or in place of a moisture measuring probe with a centering device, the first work station comprising (c1) a horizontal mounting plate arranged above the conveyor belt at a distance above the same at least corresponding to the height of container and which roughly extends over the length of the conveyor belt, below which is arranged a scanning mechanism for detecting the screw plugs of the entering empty container and which is constructed as a proximity switch, photoelectric element or the like and which is used for controlling the alignment pulleys for centering each empty container on the devices of the work station arranged above the container feedbelt and (c2) a rotaty disk rotatable on mounting plate in the container entry region about a vertical axis by means of a drive mechanism and having a central, vertical support connection on which or on vertical guides arranged on the actual rotary disk are arranged the plug unscrewing apparatus, the bunghole seeking device and the moisture measuring probe in an angular position with respect to one another by means of naturally projecting, radially directed arms fixed on the guide slides in such a way as to be vertically displaceable, an opening for the passage of apparatus being provided in the mounting plate in its region facing the container feed and centrally with respect to the forward path of the containers, (d) a second station with a filling device with a filling connection movable in the vertical direction or which can be swung into the container bunghole beng arranged on mounting plate in such a way that the filling connection of filling device is centrally arranged in the container forward path and with a balance arranged below the conveyor belt, the filling device and balance facing one another and following the first work station and the mounting plate is provided with an opening for the passage of filling connection, (e) a third work station with a plug screw-in device and with a device for receiving and mounting safety caps on the screw plugs screwed into the container openings, the third work station includes a rotary disk rotatable by means of a drive mechanism about a vertical axis in the container discharge region and having a central vertical support connection on which or on the vertical guides arranged on the rotary disk the plug screw-in device and safety cap mounting device are vertically displaceably arranged in an angular position with respect to one another by means of laterally projecting, radially directed arms fixed to guide slides, whereby in the mounting plate in its region facing the container discharge region and centrally with respect to the container feedpath is provided an opening for the passage of the devices, the third work station being located behind the second work station, (f) a plug conveyor belt running parallel to the container conveyor belt and whose plug feed-side end is located in the pivoting region of the plug unscrewing device of the first work station and whose plug dischargeside end is in the pivoting region of the plug screw-in device of the third work station and (g) parallel to the container conveyor belt and preferably as an extension of the plug conveyor belt is provided a conveyor belt for supply of safety caps to the device for receiving and mounting the safety caps of third work station, whereby after aligning the empty container which has entered the filling apparatus with its screw plug of the screw-in apparatus of the first work station which is in the screw plug unscrewing position, the same is lowered on to the screw plug, removes the same, raises it from the container fill opening and places it on the screw plug conveyor belt, puts the bunghole seeking device into operation and inserts the moisture measuring probe in the container interior and removes it therefrom, then supplies the empty screw plug-freed container to the second work station, is filled here by means of the container filling device, then the filled container is supplied to the third work station, in which the screw plug removed from the screw plug conveyor belt by means of the plug screw-in device is brought into the plug screw-in on position by pivoting the screw-in device and is screwed on to the container opening and the screw cap removed from the conveyor belt is placed on the screwed down screw plug by means of device.

Such a filling apparatus can economically fill container, particularly drums provided with screw plugs and permit and combine all the operations, such as the centering of the container to be filled on the feedpath, the unscrewing of the plug from the filling opening, the insertion of a moisture measuring probe into the container interior, the filling of the container, the screwing of the plug into the fill opening of the filled container and the mounting of safety caps on the screwed down or in plug, so that the work stations of the filling means can handle several containers simultaneously without requiring a number of work cycles, in which the individual containers have to spend long periods for individual manipulation.

By subdividing the working sequences into three work stations, it is possible to simultaneously deal with three containers, so that the empty container standing in the first workstation is initially oriented such that its fill opening closed by means of a screw plug comes to rest in the pivoting region of the devices arranged on the rotary disk of the first work station, such as the plug unscrewing device, the bunghole seeking device and the moisture measuring probe, while the container in advance of the first container is in the second work station where it is filled, whereas the container in front of it and which is already filled has been treated in the third work station to the extent that the plug has been screwed down and a safety cap mounted. The safety cap are taken from a safety cap stock, while the screw plugs are taken from a conveyor belt, which is supplied with the screw plugs unscrewed from the containers in the first work station. The container advance takes place one way, i.e. the conveyor belt for the container cyclically moves forward by section corresponding to the diameter of a container, so that containers are simultaneously associated with all three work station. For the orientation of the individual containers, the containers are gripped on their bottom, circumferential edge. Thus there is no need to use a high force, because for turning the container need only be raised slightly from its base surface, i.e. from the chain belts. The turning of the container about its longitudinal axis for orientation or alignment purposes takes place by means of the alignment rollers or pulleys on the support and centering pulleys on which the base plate of the container is engaged. Due to the face that the supporting and centering pulleys are arranged on a circular line, such that their bearing axes are radially directed and due to the fact that the pulleys are longitudinally displaceable on their bearing axes, it is possible to center and displace the supporting and centering pulleys towards the center, so that for horizontal alignment purposes the container can be moved in all directions. Due to the fact that the container rests on the centering and supporting pulleys, the bottom friction on the lifting frame is extremely small, so that a precise alignment of the container accompanied by simultaneous centering of the container fill opening is possible. It is particularly advantageous to use the supporting and centering pulleys forming the sliding surface for the container and on which the latter is displaceable in all directions, without a large amount of force having to be exerted. It is also advantageous that following a rough centering on inserting the probe-like moisture measuring device can take place by means of the container centering pin.

The gripping of the containers for orientation or alignment purposes on their bottom circumferential rim gives the advantage that the container is gripped at its most stable point, i.e. in the area having the greatest inherent rigidity, so that there are no wall surface deformations due to the gripping of the container, as is the case in known means.

The operating devices for the containers, which are combined in the first and third work stations are rotatably arranged about vertical central axes, so that only very small paths have to be covered. Due to the fact that two screw-in apparatus are used, by means of which the screw plugs are unscrewed from the filling openings of the empty container supplied and the filled containers are gain provided with screw plugs, it is possible to simultaneously deal with two containers and fill a further container.

If safety caps are to be mounted on the screwed-in plugs, then a corresponding device is provided on the rotary disk of the second work station, by means of which the safety plug supplied to the filling apparatus can be individually taken up and conveyed into the fitting position, the latter representing the position in which the screw plug is screwed on to the fill opening of the filled container.

Filling apparatuses constructed in this way exhibit an efficiency or output rise of 20% compared with those filling apparatuses in which all three work stations are combined into one. Approximately 75 fillings per hour are possible with the filling apparatus having the three work stations.

In a further embodiment of the invention the length of the container conveyor belt corresponds to four times the diameter of a container. This filling means once again includes three work stations, but the central work station located between the two outer work stations has two successively arranged filling devices and two balances located behind one another in the vicinity of the conveyor belt, a balance being associated with each filling device. A rough fill results from one filling device and a fine filling from the second filling device until the desired filling state is reached. In the first work station the container is aligned by means of the plug unscrewing device which unscrews the plug located on the filling opening. The bunghole seeking device then comes into operation and following the final alignment of the container, the moisture measuring probe is swung into the vicinity of the container filling opening. The thus prepared container is then supplied to the central work station, namely to its first filling device. A rough fill takes place there, with a balance monitoring the filled quantity. This is followed by filling to the desired fill state by means of the second filling device of the central work station, the weight of this fill once again being monitored by means of a balance. The filled and still not sealed container is then fed to the third work station. A plug is screwed on to the fill opening by means of the plug screw-in device and then a safety cap is mounted on the screw plug by means of the device for receiving and mounting screw caps. The supply of the individual containers and the operating sequence take place in individual cycles, i.e. there is a stepwise advance of the individual containers to the individual work stations or to the two filling devices of the central work station. As four containers can be simultaneously dealt with and processed with this filling means, a high work output can be obtained. This filling apparatus permits approximately 100 fillings per hour.

The invention also relates to another embodiment of a filling means, in which the length of the container conveyor belt is six times the diameter of a container. This filling apparatus also has three successive work stations, the work station located between the two outer work stations having two successively arranged filling devices and two successive balances in the vicinity of the conveyor belt. A balance is associated with each filling device. An empty space having the length of the diameter of the container is provided between each filling device and the outer work station in advance of it and the other work station following it, so the containers in the filling position can assume a position raised from the conveyor belt. The two filling devices can simultaneously fill two containers, the fill quantities supplied to the two containers being monitored by means of the two balances. For the filling process, the containers located below the two filling devices are jointly raised from the conveyor belt, so that there can be a further supply of containers and a further discharge of filled containers. The two containers are simultaneously filled by means of the filling devices, so that at the end of the filling process the two filled containers are advanced to an extent such that the furthest forward filled container is positioned below the third work station, while the other filled container is located in the empty space upstream of the third work station. Simultaneously two new prepared empty containers are supplied to the two filling devices of the central work station. These filling devices operate in alternating manner with single and double strokes, so that a very high output can be achieved. Approximately 130 fillings per hour can be attained.

Further embodiments of the invention can be gathered from the dependent claims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
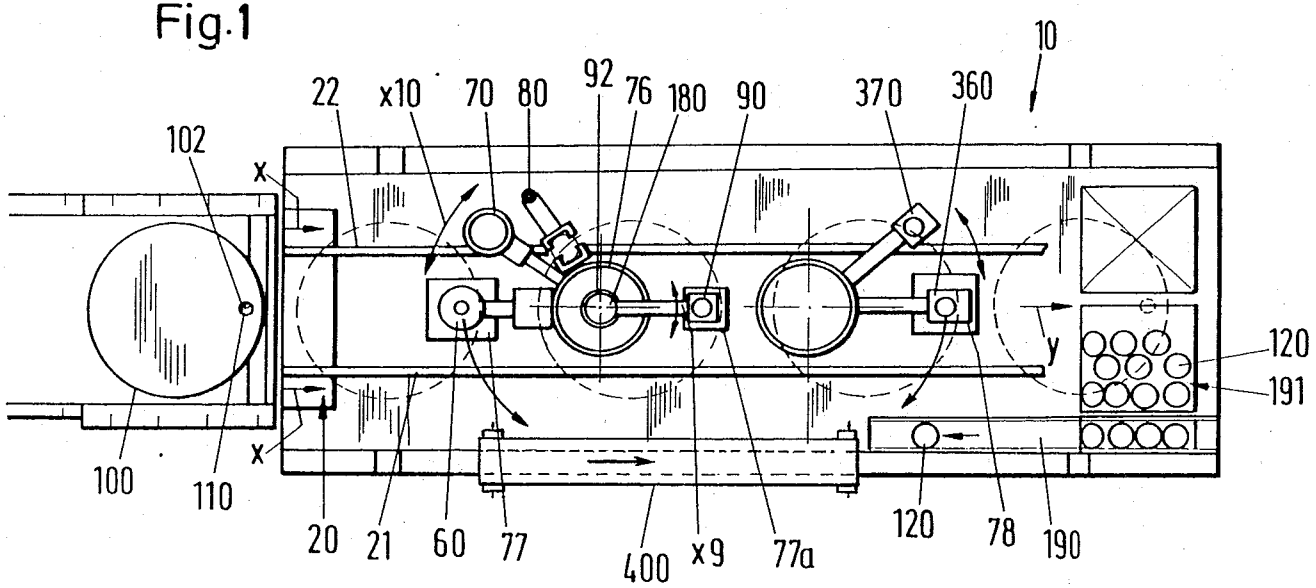
FIG. 1: A view from above the filling apparatus with its three work stations and the containers located therein in the particular processing positions.
Figure 10:
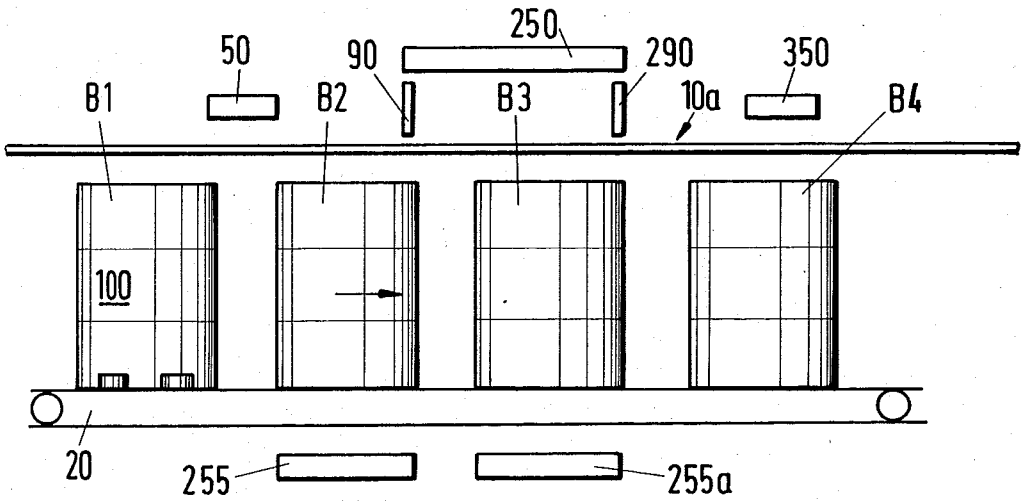
FIG. 10: A diagrammatic side view of a filling apparatus with three successively arranged work stations, the central work station comprising two filling devices.
Figure 12:
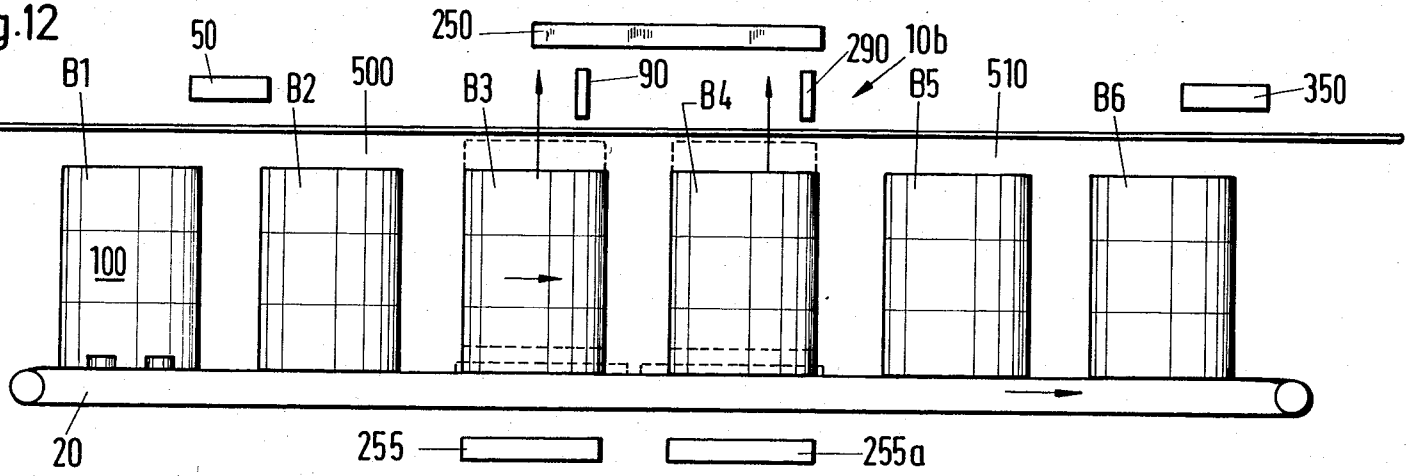
FIG. 12: A diagrammatic side view of a filling apparatus with three successively arranged work stations, the central work station comprising two filling devices and between the filling devices and the first and third work stations there is in each case an empty space for a container.

Three embodiments for filling, particularly a liquid medium into containers with screw plugs and in particular drums appear in FIGS. 1, 10 and 12. Apart from a basic construction described in greater detail hereinafter, each embodiment has three successively arranged work stations 50, 250, 350, to which the individual containers are supplied and in which the individual containers are prepared, filled and closed, and to which further reference will be made hereinafter.

Figure 2:
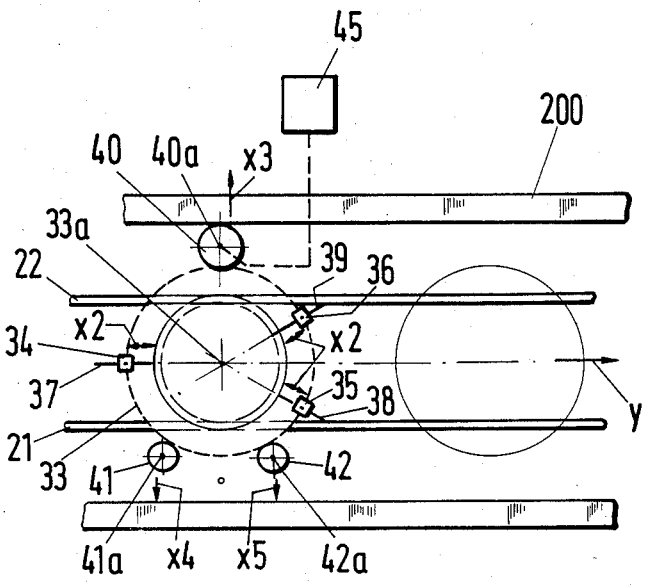
FIG. 2: A view from about of a portion of the conveyor belt of the filling apparatus with the supporting and centering pulleys and with a container mounted thereon with alignment pulleys engaging on the outer wall surface of the container.
Figure 3:
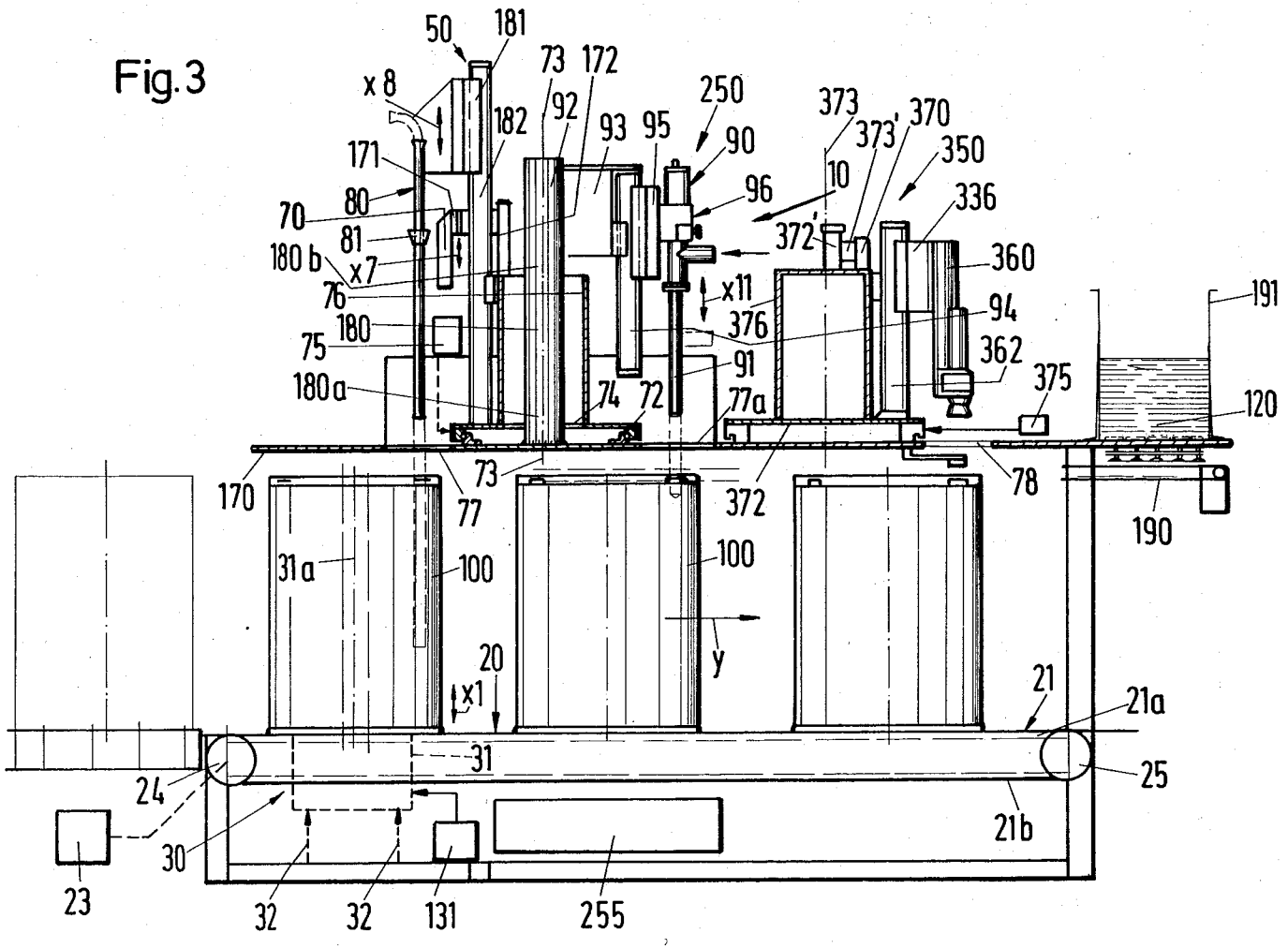
FIG. 3: Partly inside view, partly in vertical section the filling apparatus with the three work stations in the work position in which the moisture measuring probe is inserted into the interior of an empty container, a further container to be filled with its fill opening open arranged in the vicinity of the filling connection of the filling device and a third filled container in the vicinity of the third work station.
Figure 5:
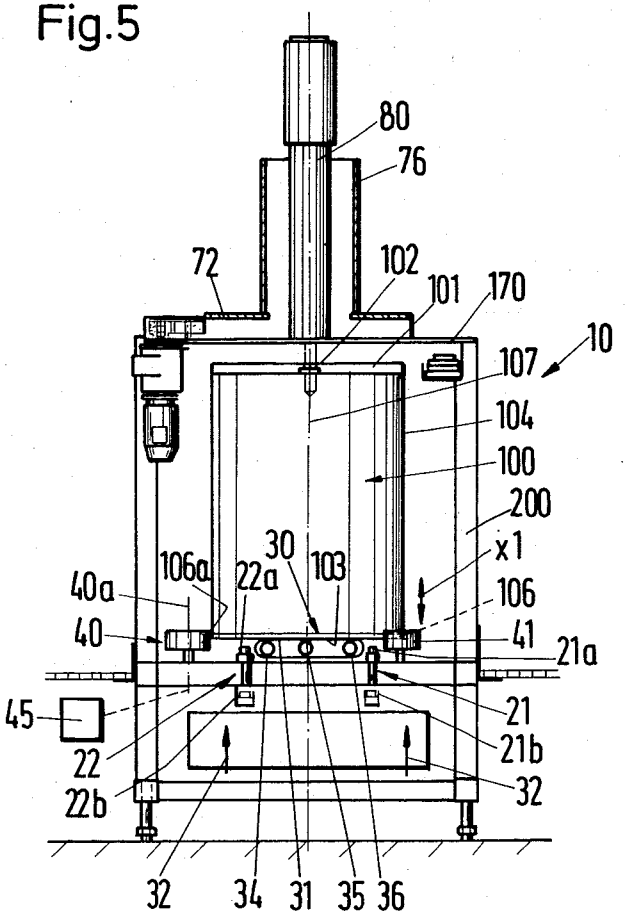
FIG. 5: A front view of the filling means.
Figure 4:
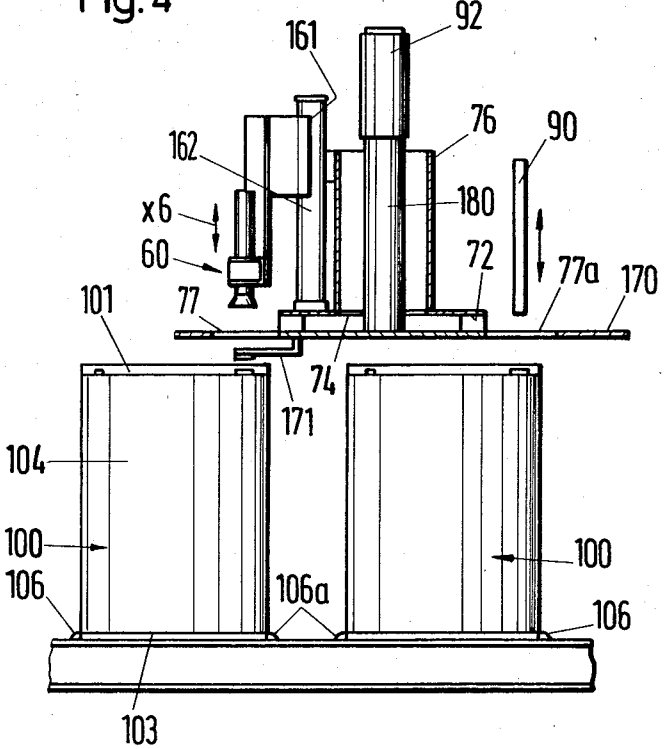
FIG. 4: Partly in side view partly in vertical section the filling apparatus with the first work station in the work position in which the screw-in device is positioned above the screw plug of a container to be unscrewed.

In FIGS. 1 to 5, an apparatus or apparatus 10 for pouring a medium, particularly a liquid medium, into containers closed with screw plugs, and in particular drums, includes a horizontal conveyor belt 20 arranged in a machine frame 200. The belt 20 carries the empty containers 100 closed by screw plugs 110. Further feed belts can be provided upstream of the conveyor belt 20. In the same way, conveyor belt 20 is followed by further discharge belts, so that the length of conveyor belt 20 is restricted solely to the region of filling apparatus 10, the length of belt 20 corresponding to three times the diameter of a container or drum 100. Container 100 includes the actual container body with container wall 104, an upper lid or cover plate 101, a fill opening 102 formed therein having a internal thread for screwing in a metal or plastic screw plug 110 and a baseplate 103 having a circumferential projecting edge 106 and a circumferential rim **106*a*. The central container rotation axis is indicated at 107 (FIGS. 4 and 5**).

The conveyor belt 20 is formed by two spaced, revolving-driven chain belts 21, 22 running in the direction of arrow X. The two chain belts 21, 22 are guided by means of corner pulleys which are mounted in machine frame 200 (FIG. 5) that receives the filling apparatus 10. In FIG. 3 two corner pulleys 24 and 25 drive the chain belt 21. The two chain belts 21, 22 have upper sides **21*a*, 22*a* and lower sides 21*b*, 22*b* (FIG. 5). The two chain belts 21, 22 are driven by a drive mechanism 23 which, in accordance with the individual working processes, controls the advance of the individual containers in the direction of arrow Y to supply the containers to the individual work stations. The advance of the containers takes place in cyclic manner. A control mechanism not shown in the drawings makes it possible to put the revolving chain belts 21, 22 out of operation and also control the time during which the two chain belts 21, 22 remain out of operation in order to be able to carry out the individual operating sequences on the containers supplied to the three work stations 50, 250, 350**.

Filling apparatus 10 also includes a device 30 for raising the individual containers 100 slightly from the upper sides **21*a*, 22*a* of the two chain belts 21, 22 (FIG. 5**).

Device 30 includes lifting frame 31, which is raisable and lowerable in the direction of arrow X1. The vertical movement of lifting frame 31 taking place by means of the lifting devices indicated by arrows 32 in FIG. 5 which can be driven hydraulically, pneumatically or electromotively.

The lifting frame 31 is positioned between the two chain belts 21, 22 or their upper sides **21*a*, 22*a* and grips the container 100 to be raised and aligned on its circumferential rim 106*a* of its baseplate 103 or on its all-round, laterally projecting edge formed in the vicinity of the baseplate 103. The lifting frame 31 only travels over a very limited distance because it must merely raise the container 100 from the upper sides 21*a*, 22*a* of chain belts 21, 22 out of operation during the alignment process. The travel distance of the lifting frame 31 need only be enough for the lifting frame 31 or alignment pulleys 40, 41, 42 to rotate the container about its longitudinal axis 107 such that its fill opening 102 closed by a screw plug 105 is aligned with the screw-in device 60 of the hereinafter described work station 50**. The latter swings into the container's forward path.

Device 30 also includes at least three supporting and centering pulleys 34, 35, 36 raisable together with lifting frame 31 and positioned between the upper sides **21*a*, 22*a* of the two chain belts and which are located on a circular line indicated at 33 in FIG. 2. In the embodiment shown in FIG. 2, three supporting and centering pulleys 34, 35, 36 support container 100, when the latter is gripped by lifting frame 31 and turned about its vertical, central longitudinal axis 107 for alignment purposes. The diameter of circular lines 33 on which the three supporting and centering pulleys 34, 35, 36 are located roughly coresponds to the diameter of container 100. However, line 33 can also have a larger or smaller diameter. It is essential that the supporting and centering pulleys 34, 35, 36 located on the circular line are arranged such that the container to be aligned is supported by its base plate 103 on the pulleys 34, 35, 36 (FIG. 5**).

The three supporting and centering pulleys 34, 35, 36d are arranged in the manner shown in FIG. 2, i.e. the three supporting and centering pulleys are positioned between the upper sides **21*a*, 22*a* of the two chain belts 21, 22. Pulley 34 is located in the container entry direction. The two other pulleys 35, 36 then being located on the side remote to the feed direction for containers 100**.

All three centering and supporting pulleys 34, 35, 36 are arranged in overhung manner bearing spindles or axes 37, 38, 39 located in the machine frame of filling apparatus 10. All three bearing axes are radially directed to the vertical, roughly central, container rotation axis 107, as can be seen from FIG. 2, i.e. the extensions of the three bearing axes 37, 38, 39 meet in the centre 33a of circular line 33. Each of the supporting and centering pulleys 34, 35, 36 is, as a result of its overhung arrangement, freely displaceable on its bearing axis 37, 38, 39 in the longitudinal direction of the bearing axis. As a result of the displaceability the supporting and centering pulleys 34, 35, 36 is displaceable horizontally in all directions. Hence a fine centering and alignment of the container with its fill opening is possible. The bearing spindles 37, 38, 39 for the centering and supporting pulleys 34, 35, 36 have corresponding lengths, so that the pulleys have an adequate displacement path. The free displaceability of the supporting and centering pulleys 34, 35, 36 is indicated by arrow X2 in FIG. 2. Due to the fact that the lifting frame 31 grips the container 100 to be aligned in its bottom-side region, i.e. in the region having the greatest inherent rigidity and strength, no deformation of the container, particularly of its wall 104 takes place. Hence the filling apparatus 10 can also be used for filling thin-walled containers 100.

In addition, device 30 has alignment rollers or pulleys 40, 41, 42, which are arranged in the circumferential region of container 100 standing on the supporting and centering pulleys, 34, 35, 36. The rollers or pulleys 40, 41, 42 are arranged such that the alignment pulleys are supported on the container outer wall surface 104 or on the circumferential rim 106*a* of container baseplate 103, i.e. bear in these regions. It is particularly advantageous if alignment pulleys 40, 41, 42 can also bear on the circumferential edge 106 of has the maximum inherent rigidity and strength and can scarcely be deformed if a pressure is exerted from the outside on the circumferential edge 106 (FIG. 4).

The embodiment of FIG. 2, shows three alignment pulleys 40, 41, 42. Alignment pulley 40 is located outside chain belt 22 and the two other alignment pulleys 41, 42 are horizontally positioned outside chain belt 21. The bearing axes or spindles 40*a*, 41*a*, 42*a* of the three alignment pulleys 40, 41, 42 are vertically positioned in the machine frame 200 of filling apparatus 10. Preferably, of the three alignment pulleys 40, 41, 42, alignment pulley 40 is turned by the drive mechanism 45, so as to be able to rotate container 100 about its vertical central axis 107. Container 100 is then supported on the two other alignment pulleys 41, 42 during rotation, the container rotary movement being aided by pulleys 41, 42. All three alignment pulleys, 40, 41, 42 can be swung in and out by means of mechanisms not shown in the drawings, such as support arms and the like and this takes place in the direction of arrows X3, X4, and X5. Alignment pulleys 40, 41, 42 also permit a lateral alignment of container 100, in that the pulleys are brough into a position in which they bear on container wall 104, or on the circumferential bottom edge 106, or on the circumferential bottom rim 106*a* of container 100. In the latter case, lifting frame 31 is constructed such that the engagement of the alignment pulleys is not impeded. The swing-in positions of the three pulleys 40, 41, 42 are such that during their swing in for engaging container 10, the latter is moved on supporting and centering pulleys 34, 35, 36 while being simultaneously raised by lifting frame 1 from the upper sides 21*a*, 22*a* of chain belts 21, 22. Lifting frame 31 is constructed such that with to support the container 100 on its bottom-side circumferential edge 106, so that, on rotating container 100 about its central longitudinal axis 107, the container can move on lifting frame 21. The friction which occurs is extremely small, because the container weight is essentially supported on the three supporting and centering pulleys 34, 35, 36 and due to the construction of the pulleys is horizontally displaced thereon. The overall alignment of container 100 is performed by alignment pulleys 40, 41, 42. Preferably the alignment pulleys are spring-loaded, so as to obtain as adequate contact pressure.

All components of the container raising device 30 can be brought together in a standard system, so that lifting frame 313, supporting and centering pulleys 34, 35, 36 and alignment pulleys 40, 41, 42 are arranged in a frame such that all three components function cooperate and permit a very precise container alignment.

The alignment pulleys 40, 41, 42 engaging on the circumferential rim 106*a* or the circumferential edge 106 of container 100 can be revolved by using appropriate drive mechanisms, with the rotation directions of all the alignment pulleys then being identical. The drive mechanisms for alignment pulleys 40, 41, 42 are combined in a control system not shown in the drawings and which cooperates with a scanning mechanism 171 to be described in greater detail hereinafter.

The devices for unscrewing the screw pulg from the filling openings of the containers, for seeking the bunghole, for measuring the humidity in the empty containers are combined in a first work station 50 which forms part of the filling apparatus 10. The plug unscrewing device which is constructed in a known manner is designated 60, the bunghole seeking device 70 and the moisture measuring probe 80. All these devices 60, 70 and 80 are constructed in a a known manner. The bunghole seeking device 70 can be constructed as an optical or electronic or optoelectronic scanning device. It need not be an integral part of work station 50 and can instead be positioned in the vicinity of the forward path of the empty containers to the first work station 50 and further reference will be made thereto hereinafter.

Devices 60, 70, 80 of the first work station 50 are combined on a mounting plate 170, which is an integral part of machine frame 200 of the filling apparatus and which is positioned at a distance above conveyor belt 20 such that the distance between the belt 20 and plate 170 at least corresponds to the height of container 100 to be filled, and so that on the conveyor belt containers 100 can be effortlessly moved past below mounting plate 170. Mounting plate 170 is located in machine frame 200 of filling apparatus 10 (FIGS. 1 and 3). Mounting plate 170 preferably extends at least over the entire length of conveyor belt 120.

Below the mounting plate 170, a scanning device 171 in the container entry zone is in the form of a proximity switch, photoelectric cell or the like and is used for controlling the alignment pulleys 40, 41, 42 (FIG. 4). The empty container running into filling apparatus 10 with its screw plug still screwed into its fill opening is slightly raised from conveyor belt 20 by means of lifting frame 31. The alignment pulleys 40, 41, 42 are then engaged on the circumferential edge 106 or on the circumferential rim 106*a* of container 100. On putting the alignment pulleys 40, 41, 42 into operation, i.e. when they are rotated, container 100, which is held by lifting frame 31 and is supported by its baseplate 103 on the supporting and centering pulleys 34, 35, 36, is then aligned with respect ot its fill opening with the aid of scanning device 171. The container is brought into the position in which the container fill opening with the screw plug comes to rest in the working zone of the plug unscrewing device 60 or the moisture measuring probe 80. Hence on lowering the screwing device 60 the screw head of the latter comes to rest on the container screw plug, which it grips and unscrews from the fill opening thread. This precise alignment of the container is controlled by means of the scanning device 171.

On the top surface of mounting plate 170 is a disk 72 rotatable about a vertical axis 73 and supported adjacent to its curcumferential rim on roller or antifriction bearings. Rotary disk 72 is rotated by means of a drive mechanism 75. Rotary disk 72 has a central opening, preferably a circular opening 74 and in the vicinity thereof carries an upwardly extending support connection 76 constructed as a hollow cylinder (FIGS. 3 and 4).

In the rotary zone of rotary disk 72 an opening 77 in mounting plate 170 serves for the passage of devices 60, 70, 80 (FIGS. 3 and 4). This opening 77 in mounting plate 170 is associated with the advance movement of the empty container, so that if a container is introduced into the vicinity of the first work station 50, then the closed fill opening of the container comes to rest in the vicinity of the opening 77 in plate 170, so that devices 60, 70, 80 can in each work sequence a be passed through the opening 77 as necessary.

Rotary disk 72 carries the device 60 for unscrewing of the screw plugs, the bunghole seeking device 70, if the latter is required, as well as the moisture measuring probe 80. For receiving the devices, rotary disk 72 carries vertical, column-like guides 162, 172, 182, on which devices 60, 70, 80 are displaceable in the direction of arrows X6, X7, and X8. This displacement of devices 60, 70, 80 on guide columns 162, 172, 182 takes place in response to drive mechanisms not shown in the drawings.

The guide column or posts 162, 172, 182 carry guide slides 161, 171, 181 with laterally projecting arms whose free ends carry devices 60, 70, 80, so that in the case of vertical movement of guide slides 161, 171, 181 on guide columns 162, 172, 182, devices 60, 70, 80 participate therein. Opening 77 in mounting plate 170 is positioned such that, if devices 60, 70, 80 are brought into their working position by rotating rotary disk 72, they are aligned with the devices 60, 70, 80, so that the latter can be passed through opening 77 in mounting plate 170. Thus, opening 77 faces the container entrance region. In addition, guide columns 162, 172, 182 can be connected via connecting webs to the supporting connection 76 or rotary disk 72 is rotated, devices 60, 70, 80 also participate in the rotation.

In the vicinity of the vertical rotation axis 73 of rotary disk 72, a further supporting column or post 180 is positioned centrally with respect to rotary disk 72 and its bottom end 180a passes through the central opening 74 in rotary disk 72. Supporting column 180 is fixed by its bottom end 180a to mounting plate 170 and can consequently not participate in the rotation of rotary disk 72. Rotary disk 72 is annular and runs round the fixed supporting column 180. The latter is arranged in the interior of the hollow cylindrically constructed support connection 76 of rotary disk 72 and a portion **180*b* passes out of the connection 76. The portion 180*b* or 92 of supporting column 180 support members 93, 95, and 96 a filling device 90 which forms part of the second work station 250 and includes a filling connection 91 (FIG. 3). The latter is connected by means of a dosing mechanism, not shown in the drawing, to a storge container containing the product to be filled. This filling device 90 of the second work station 250 is positioned above mounting plate 170, which contains an opening 77 a, through which the filling connection 91 can be lowered and inserted in the interior of the container to be filled. However, there is no need for filling device 90 to be fixed to the supporting column 180. It is also possible to provide the rotary disk 72 with a central supporting connection 76 for supporting devices 60, 70, 80, while the filling device 90 can be arranged on a separate supporting connection, which follows rotary disk 72 with devices 60, 70, 80 of the first work station 50. Guide columns 162, 172, 182 for devices 60, 70, 80 can also form an integral part of supporting connection 76 of rotary disk 72 or the connection 76 can be provided with corresponding guides on its outer wall surface and they then receive the guide slides 161, 171, 181 for devices 60, 70, 80**.

As a result of this construction only devices 60, 70, 80 participate in the rotary movement of the rotary disk 72, whereas filling device 90 does not participate in the movement, because filling device 90 is not connected to the rotary disk 72 and is instead held on supporting column 180. The latter is fixed to mounting plate 170, or is fixed to a further supporting column shown in FIG. 6 and arranged to stand vertically on mounting plate 170 and to follow work station 50 with rotary disk 72. Filling apparatus 10 also includes a further or third work station 350, which has the plug screw-in device 360 and the device 370 for receiving and mounting safety caps 120 on to the screw plugs already screwed into the container filling openings. This third work station 350 includes a rotary disk 372 rotatable about a vertical axis 373 by means of a drive mechanism 375 in the container discharge region on mounting plate 170. It carries a central, vertical support connection 376. The connection 376 or the vertical guide 362, 372' are arranged on rotary disk 372 and hold the vertically displaceable plug screw-in device 360 and the safety cap mounting device 370 by means of laterally projecting, radially directed arms fixed to guide slides 363, 373'. The region facing the container discharge area in mounting plate 170 and and centrally with respect to the container forward path has an opening 78 for the passage of devices 350, 370. This third work station 350 follows the second work station 250 (FIG. 3).

In the vicinity of conveyor belt 20, a balance 255 is associated with filling device 90 of work station 250 and makes it possible to control the filling device 90 such that when the fill quantity weight set on balance 255 is reached, the further supply of fill material into device 90 is interrupted. Balance 255 is constructed such that prior to the filling process the weight of the empty container is determined and stored in a memory not shown in the drawings. The memory then receives the weight of the filling quantity necessary in each case, so that when the filling quantity is reached, balance 255 interrupts the further supply of filling material. Balance 255 can be replaced by differently constructed apparatus enabling the filling quantity to be monitored and determined. Thus, it is inter alia possible to use fill level measuring probes. When using a balance 255, an additional device (not shown in the drawing) in the vicinity of conveyor belt 20 allows the container to be filled slightly raised for the filling process. The additional device is then in operative connection with balance 255 in the raised state.

Figure 9:
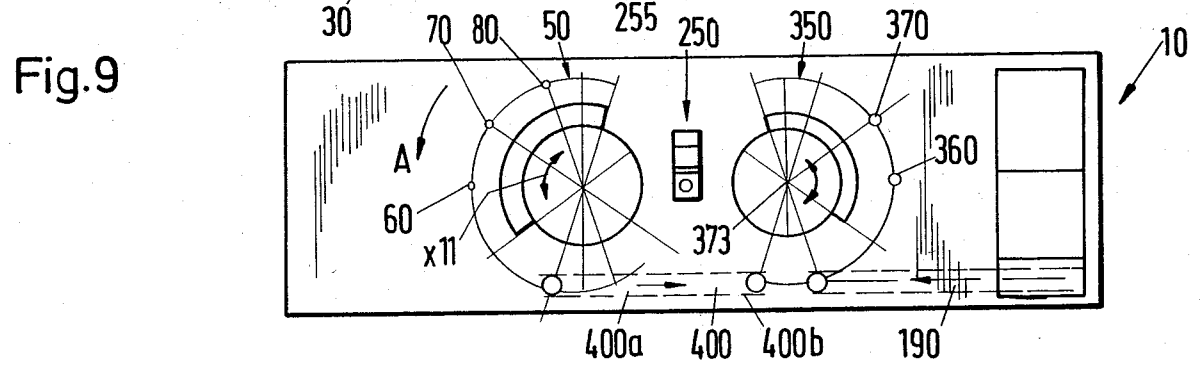
FIG. 9: A plan view of the filling apparatus according to FIG. 8.

Screw plugs travel to the plug screw-in device 360 of the third work station 350 onn a plug conveyor belt 400 running parallel to the container conveyor belt 20 in the machine frame 200 of filling apparatus 10. The plug engagement end 400 a of conveyor belt 400 is located in the pivoting region of the plug unscrewing device 60 of first work station 50, while the plug removal end 400b of the plug conveyor belt 400 is in the pivoting region of the plug screw-in device 360 of the third work station 350. Hence the screw plug which device 60 unscrews from the container filling openings, following the pivoting of the device 60 in the vicinity of conveyor belt 400 of the device 60, pass to conveyor belt 400. The conveyor belt 400 supplies the plug to the plug screw-in device 360 of the third work station 350 in the vicinity of conveyor belt 400. The plug screw-in device 360 grasps the individual plugs and, after swinging into the plug screw-in position, screws the screw plug into the container fill opening or on to the externally threaded container filling connection (FIG. 9). The screw plug conveyor belt 400 is constructed as a revolving, endless belt. The plug screw-in device 360 then screws the plugs unscrewed from the empty containers fed into work station 50 back into the container filling openings in the third work station 350.

Parallel to the container conveyor belt 20 and preferably in an extension of the plug conveyor belt 400, a further conveyor belt 190 supplies safety caps 120 to device 370 of third work station 350. Device 370 takes up the safety caps individually fed to conveyor belt 190. Following a corresponding pivoting movement of device 370 the latter brings the safety caps into the vicinity of the fill opening of the filled container already closed with a screw plug and then fits the cap on the plug. FIG. 1 indicates at 190 the supply of safety caps 120 to device 370 for mounting the the caps on the already screwed in screw plugs. The feedbelt 190, which can be constructed as a revolving belt, supplies the safety cap 120 from a storage container 191 to device 270, when the device 370 has been swung into the vicinity of feedbelt 190. The feedbelt 190 takes up a position in which the individual caps are received from device 370 and after transferring device 370 into the mounting position, the caps are mounted on the screw plugs. The safety caps can be stacked in the storage container 191. The unstacking of the individual safety caps takes place by a reversing safety cap fitter constructed in a known manner and of the type used for unstacking deep-drawn lids. An unstacking of the individual safety caps from the stack can also take place by sliding off the individual caps. The individual safety caps can all be unstacked by removing with fee spirals.

In the case of containers whose filling openings are closed by means of screw plugs, the plug unscrewing device 60 and plug screw-in device 360 are used. If, in place of screw plugs, press-in plugs are used, then the individual devices 60, 360 have a corresponding construction for drawing the plugs out of the fill opening and for pressing them in by exerting pressure. The plug unscrewing device 60 and plug screw-in device 360 can be identically constructed if they are simultaneously in a position to screw in and out screw plugs. If such devices are used in the first and third work stations 50 and 350, then the devices will only perform the work sequences required in each case for unscrewing and screwing in the plugs.

Figure 6:
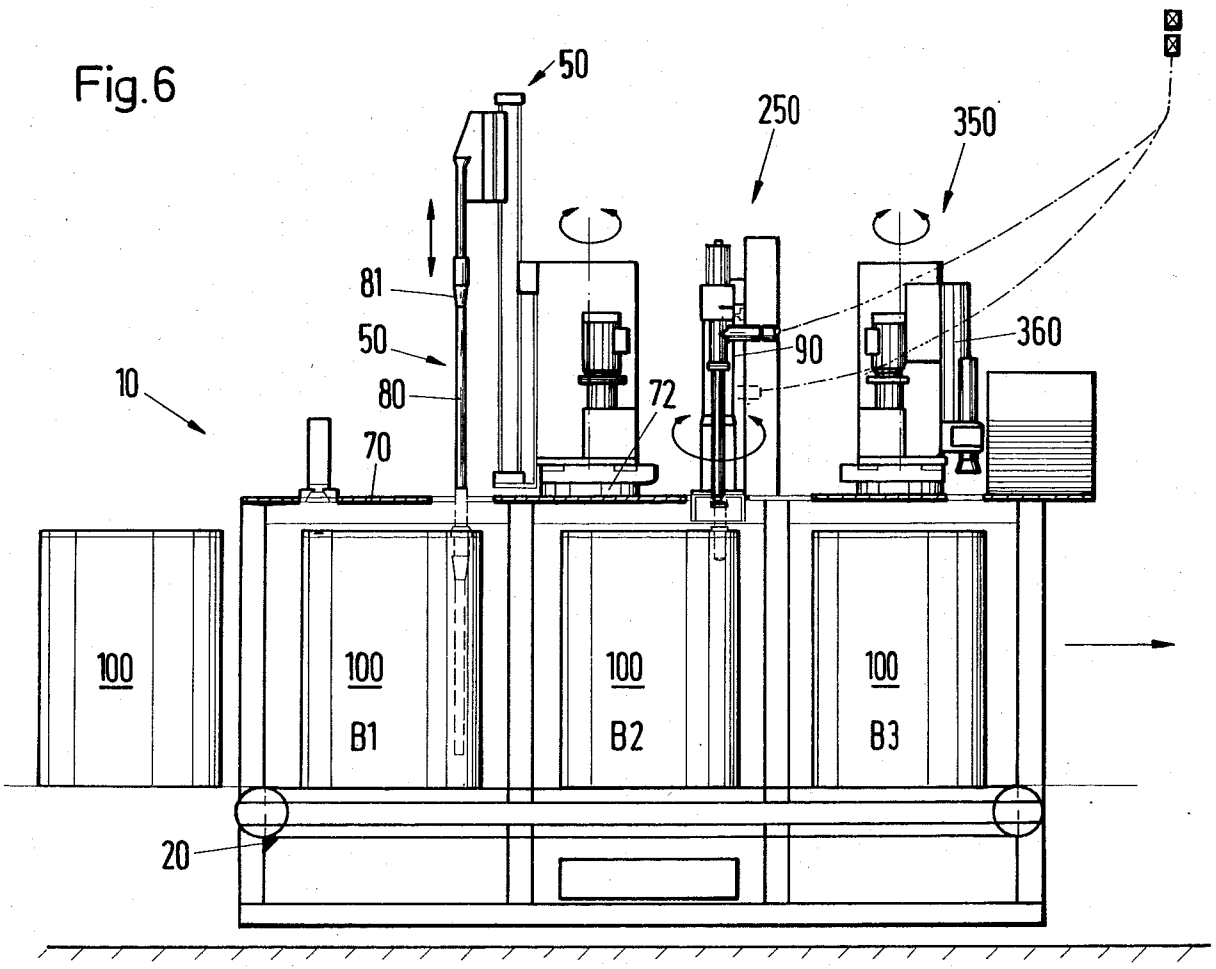
FIG. 6: A side view of a further embodiment of the filling apparatus with a laterally pivotable filling device.
Figure 7:
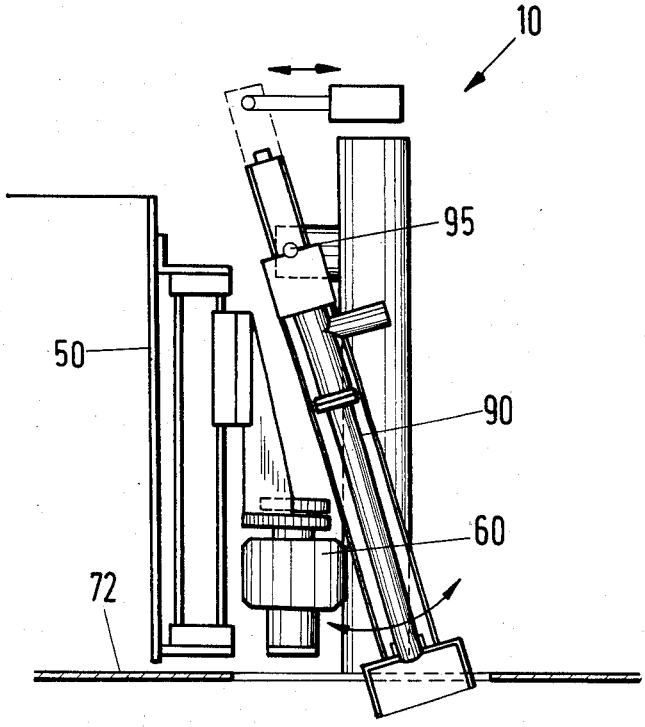
FIG. 7: A side view of the laterally pivotable filling device.

In the embodiment of the filling apparatus shown in FIGS. 6 and 7, filling device 90 does not form part of the first work station 150 and connected to supporting column 180 and instead can be fixed so that it can be laterally swung in and out on machine frame 200 of the filling apparatus or on the mounting plate 170. In the latter case, the mounting plate must have a correspondingly large opening, so that filling device 90 can be swung into the filling position. Filling devices 90 can be constructed so that it can be swung into and out of the filling position, but it is also possible to adopt a stationary arrangement of filling device 90. If the filling device is constructed so that it can be swung in and out, then this takes place about the fulcrum indicated at 95 in FIG. 7.

Figure 8:
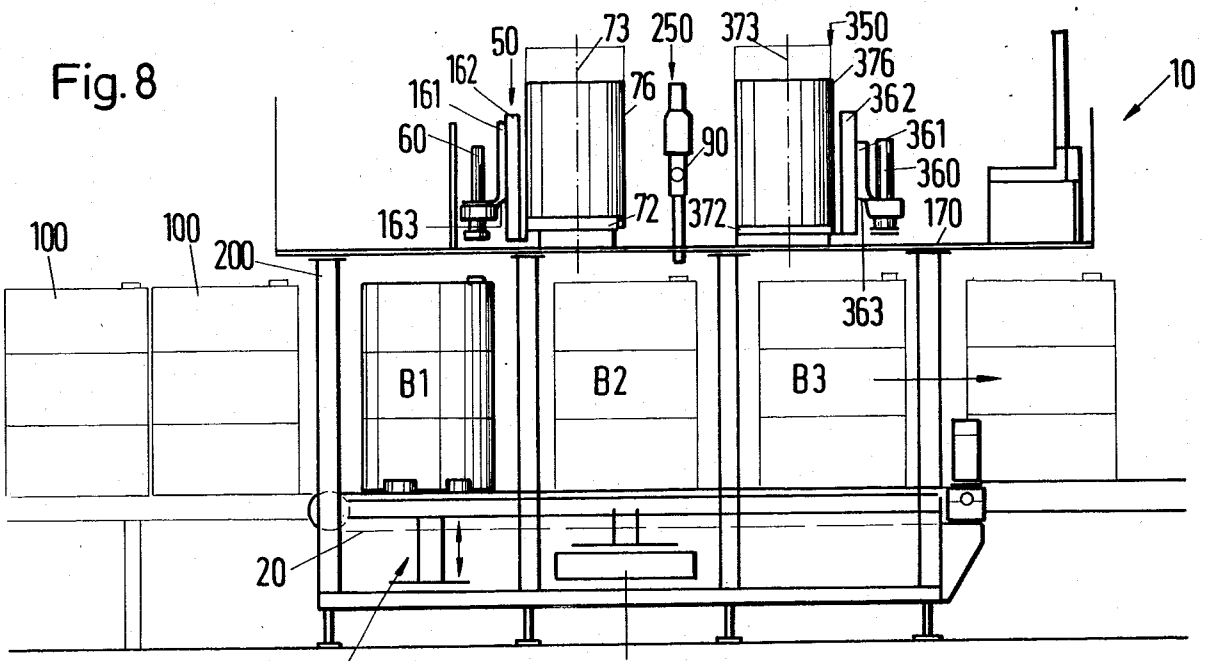
FIG. 8: A simplified side view of the filling apparatus operating with three work stations.

The filling apparatus 10 functions as follows. A container B1 is introduced to such an extent on conveyor belt 20 that the container comes to rest below first work station 50 (FIG. 8). The lifting frame 31 slightly raises the container from the upper sides 21*a*, 22*a* of chain belts 21, 22 of stationary conveyor belt 20, with lifting frame 31 grasping the circumferential edge 106 or the bottom circumferential rim 106*a* of the container. Simultaneously the container is supported on the supporting and centering pulleys 34, 35, 36 raised together with lifting frame 31, whereby the pulleys can be an integral part of the lifting frame. Alignment pulleys 40, 41, 42 are then engaged on the circumferential rim 106*a* of the container, alignment pulley 40 already constituting the lateral boundary during the container alignment process, i.e. the pulley 40 constitutes a fixed stop. This is followed up by the two other alignment pulleys 41, 42 such that the container comes to rest between alignment pulleys 40, 41, 42 (FIGS. 2 and 5).

If alignment pulleys 40, 41, 42 or only alignment pulley 40 are driven, then the container is so rotated and displaced about its longitudinal axis 107 until its fill opening 102 with the screw plug 110 still in the filling position assumes the position shown in FIG. 6 below rotary disk 72 and below the front opening 77 in mounting plate 170. The complete alignment process is controlled by means of scanning mechanism 171 or via corresponding control elements not shown in the drawings, in which all the drive mechanisms of the work station device are brought together. The individual operating sequences are then controlled in the necessary order by the control elements or the control mechanism. Another possibility for controlling the alignment process is available via the bunghole seeking device 70, which is rotating rotary disk 72 is pivoted over an area of the bunghole or the empty container fill opening 102. It is advantageous if the plug unscrewing device 60 previously unscrews the screw plug from the container fill opening 102 to enable the bunghole seeking device 70 to be inserted. In place of the bunghole seeking device 70 in work station 50, alignment can also take place by scanning device 171. All the control elements necessary for carrying out the alignment process, together with the associated drive mechanisms can be combined in a control mechanism, so that the individual working sequences can be carried out in the the necessary order in each case.

The thus prepared, roughly aligned container B1 assumes the position shown in FIG. 8 below work station 50. It is assumed that when carrying out a continuous filling process, a container 82 has been introduced before container B1 and has assumed the position of FIG. 8 in front of B1, the position being the filling position below the second work station 250 (FIG. 6).

If the container B1 has assumed the position shown in FIGS. 6 and 8, then rotary disk 72 is rotated in the direction of arrow X11 until screw-in device 60 has assumed position A in FIG. 9 and is located in this position above the screw plug of empty container B1. Screw-in device 60 is lowered with its screwhead on to the screw plug of container B1. The screw plug is gripped and by means of a rotary movement about a vertical axis is unscrewed from the thread of the filling connection forming or bounding the container filling opening. Screw-in device 60 then moves upwards and take with it the unscrewed screw plug. This is followed by a further zonal rotation of rotary disk 72 in the direction of arrow X11, so that the screw-in device is moved out of position A until the bunghole seeking device 70 has been moved into position A. If screw-in device 60 is moved out of position A in the direction of arrow X11, then the bunghole seeking device 70 follows the rotary movement. If there is no bunghole seeking device 70, then on rotating disk 72 and on swinging out the screw-in device 60 from position A, moisture measuring probe 80 is swung into position A, so that then probe 80 assumes the position shown in FIG. 6, this position being position A in FIG. 9. Moisture measuring probe 80 is lowered through the container fill opening 102 into the interior of the empty container. Simultaneously probe 80 produces a further alignment, i.e. fine centering, with the recentering pin 81 provided on the moisture measuring probe 80. The probe 80 surrounds the latter and on inserting the latter precisely recenters the fill opening or the bunghole of the empty container. During this process, the alignment pulleys 40, 41, 42 are released from the container rim, so that the container can move freely on the supporting and centering pulleys 34, 35, 36. The external diameter of recentering pin 81 (FIG. 6) precisely fits in the container filling opening. In this position the lifting frame 31 is lowered and aligns the container on chain belt 21, 22. However, there is also no need for the moisture measuring probe. In this case only the recentering pin 81 is provided, which takes the place of the moisture measuring probe 80 and is automatically inserted in the container fill opening by corresponding drive means.

On rotating disk 72 and in case of a simultaneous lateral pivoting of screw-in device 60, the screw plug grasped by screw-in device 60 is placed on conveyor belt 400 and supplied to the plug screw-in device 360 of the third work station 350.

The thus prepared container B1 is now supplied to work station 250 and its filling device 90, such that the filling connection 91 of filling device 90 comes to rest in the vicinity of the fill opening 102 of empty container B2. Simultaneously container B2 is supported on balance 255 of work station 250. This is followed by filling and when filling is at an end the filled container is supplied to the third work station 250 by means of the switched on conveyor belt 20. FIGS. 6 and 8 designate the filled, but not yet sealed container as B3. In this position of container B3, the plug screw-in device 360 engages and screws down the screw plug taken by conveyor belt 400 on to the container fill opening 102. After rotating rotary disk 372 about its vertical axis 373, the plug screw-in device 360 is swung out of the screw-in position and the safety cap mounting device 370 connected to rotary disk 372 is swung into the plug screw-in position. Device 370 has previously received a safety cap 120 from feedbelt 190 and places the cap on the screw plug. After container B3 has been sealed on this way, it is moved out of the filling apparatus and simultaneously the containers following container B3 are introduced into the corresponding work stations 50 and 250, as well as 350. The advance of the individual containers take place in cyclic manner, so that after each container has reached a work station and the corresponding operating sequences have been performed therein, the container is fed to the following work station in each case. By means of filling apparatus 10, simultaneously three containers can be prepared by means of the three work stations 50, 250, 350 (FIGS. 8 and 9). Rotary disks 72, 372 can be moved backwards and forwards. Devices 360, 370 are at a reciprocal angular position such that if device 360 is located in the vicinity of conveyor belt 400, device 370 is in the vicinity of feedbelt 190.

Figure 11:
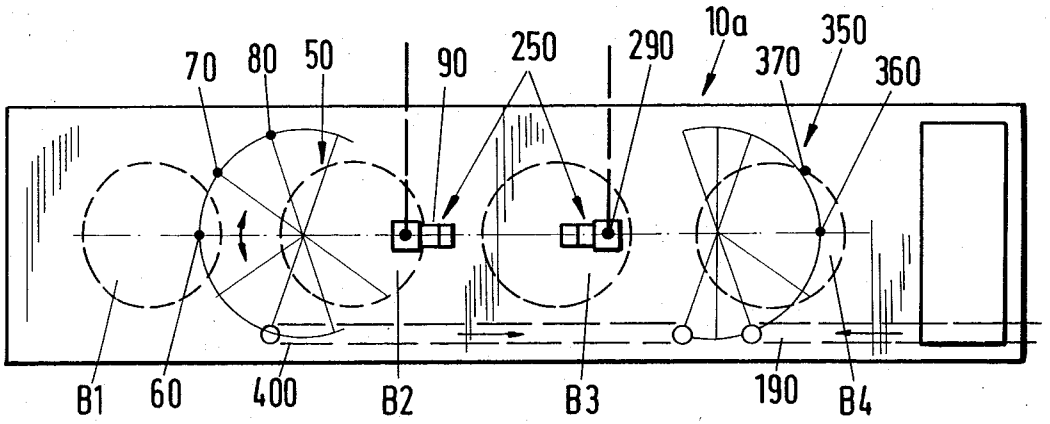
FIG. 11: A plan view of the filling apparatus according to FIG. 10.

Filling apparatus **10*a* shown in FIGS. 10 and 11 is constructed in a similar manner to filling apparatus 10, filling apparatus 10*a* having a first work station 50 a second work station 250 and third work station 350. The difference compared with filling apparatus 10 is that work station 250 of filling apparatus 10*a* has two filling devices 90, 290 and two balances 255, 255*a* associated therewith. Conveyor belt 20 on which the containers are advanced to work stations 50, 250, 350 has at least four times the length of a container diameter. The construction of conveyor belt 20 and device 30 for raising the individual container 100 from chain belts 21, 22 of conveyor belt 20, as well as work stations 50 and 350 are constructed in the same way as for filling apparatus 10. The operating sequences performed in the two work stations 50, 350 once again correspond to those filling apparatus 10, with the sole difference that through the construction of work station 250 with two filling devices 90, 290 filling apparatus 10*a* can simultaneously deal with four containers B1, B2, B3, B4. Also in the case of the embodiment according to FIGS. 10 and 11, the three work stations 50, 250, 350 are successively arranged in the container advance direction and this also applies to the two filling devices 90, 290. In the same way as with the filling apparatus 10, the screw plug is unscrewed from container B1 in the first work 50 by the plug unscrewing device 60 and is placed on conveyor belt 400, from where the individual screw plugs are taken by the plug screw-in device 360 of work station 350 and screwed on to the fill opening of the filled container. In the case of the filling apparatus 10*a*, the safety caps 120 are once again placed on the screwed-down screw plugs, the safety caps 120 being supplied by means of feedbelt 190 to work station 350**.

The two filling devices 90, 290 are constructed such that filling device 90 initially produces a rough fill whereas filling device 290 permits a fine fill, i.e. the still lacking filling product or liquid quantity is added to the container by filling device 290, so as to reach the given overall fill quantity. The balance 255 associated with filling device 90 is set such that a filling product quantity is supplied to the container which is still below the actual desired value, so that filling device 290 then supplies the container with product until the desired weight value set on balance **255*a*** or previously supplied thereto is reached.

Filling apparatus **10*a* according to FIGS. 10 and 11 functions in the following way. Container B1 is supplied to filling apparatus 10*a* and stopped in the vicinity of work station 50. As described hereinbefore, container B1 is aligned here, the screw plug located on the fill opening is unscrewed by means of the plug unscrewing device 60 and placed on conveyor belt 400, while the bunghole seeking device 70 is moved into the vicinity of the fill opening of container 81 and engages the fill opening therewith. The liquid measuring probe 890 is then pivoted into the vicinity of the fill opening of container B1 and is lowered, the probe 80 also permitting the recentering of the container. After the removal of the moisture measuring probe 80, container B1 is then supplied to the first filling device 90 of the second work station 250, is stopped in the vicinity of the latter such that the container is filled at B2 by means of filling device 90. However, the predetermined desired weight is still not reached and instead the quantity in container B2 is below the desired value corresponding to the total container filling quantity. The control of the filling product feed takes place by means of a weight-based determination by means of balance 255 or other appropriate devices, which monitor the fill level or the predetermined upper fill level. When container B2 is nearly filled, it is supplied to the second filling device 290 of work station 250. In this position the original container B1 is indicated at B3. In this position below filling device 290, the container is then topped up to the given desired weight or quantity, the control once again taking place by means of balance 255*a*. When container B3 is filled, it is moved into the third work station 350, where the fill opening is sealed by means of a screw plug using the plug screw-in device 360. The mounting of a safety cap 120 takes place by means of device 370 provided in work station 350**. The container is indicated at B4 in this treatment position. While container B1 passes through the individual stages B2, B3 and B4, new empty containers pass into the filling apparatus 10*a*, so that during a stepwise advance of the containers from the first work station 50 to the first filling device 90 and from the latter to the second filling device 290 and from the latter to the third work station 350, the containers pass through all the individual work stations, so that simultaneously four containers on conveyor belt 20 are prepared, dealt with and loaded, which leads to a high output of the overall filling apparatus 10*a*.

Figure 13:
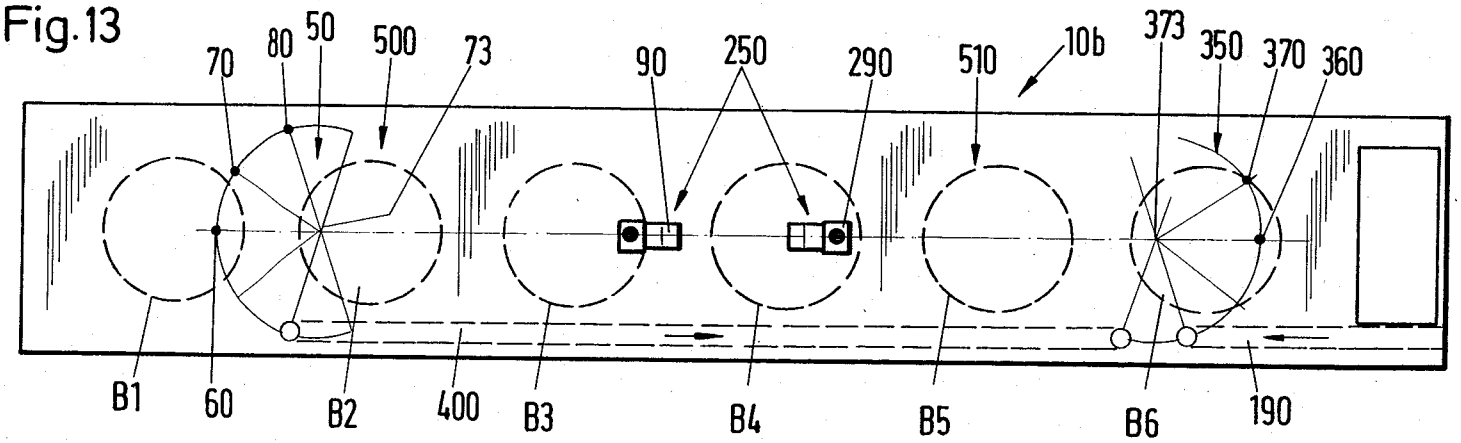
FIG. 13: A plan view the filling apparatus according to FIG. 12.

FIGS. 12 and 13 show another embodiment of a filling apparatus 10b, in which the conveyor belt 20 for containers 100 has a length corresponding to roughly six times the diameter of a container. Here again, the construction and design of conveyor belt 20 corresponds to that of filling apparatus 10 and 10*a*. The same container alignment device is provided with filling apparatus 10b, which also applies with respect to the conveyor belts 400 for the screw plugs and 190 for the safety caps.

Filling apparatus 10b includes a first work station 50 with a plug unscrewing device 60, bunghole seeking device 70 and moisture measuring probe 80 and at the end of the passage path the third work station 350 with the plug screw-in device 360 and device 370 for receiving and mounting safety caps. Between the two work station 50, 350 is provided work station 250, which is constructed corresponding to station 250 of filling apparatus 10*a*. The two work stations 50, 350 for filling apparatus 10b are constructed in the same way as for filling apparatus 10. Also in the case of filling apparatus 10b, work station 250 includes two filling devices 90, 290, and the balances 255, 255*a* associated therewith. Between the first work station 50 and the first filing device 90 of work station 250 and between the second filling device 290 of work station 250 and third work station 350 is in each case provided a container empty space 500 or 510, whose diameter roughly corresonds to that of a container 100, so that the containers can be placed in the empty spaces 500, 510. The length of conveyor belt 20 in the case of filling apparatus 10b is such that six containers can be successively stood on the conveyor belt, it being advantageous if there is a corresponding spacing between the individual containers. The spacings between the individual containers are predetermined by the arrangement of work stations 50, 250, 350. The same also applies with respect to the conveyor belts of filling apparatus 10 and 10*a*, which are correspondingly dimensioned in accordance with the number of containers to be received. Besides conveyor belt 20, filling apparatus 10*b* has conveyor belt 400 for the screw plugs and feedbelt 190 for safety caps 120. Work stations 50, 350 are constructed in the same way as the work stations described hereinbefore and have the same working sequences. The filling devices 90, 290 provided in work station 250 constructionally correspond to the filling devices of filling apparatus 10*a*, but with the difference that filling devices 90, 290 completely fill the containers. With both filling devices 90, 290 are associated balances 255, 255*a*. In the vicinity of the two filling devices 90, 290, conveyor belt 20 is constructed is such a way that the containers can be raised for the filling process. Raising takes place by means of devices constructed in per se known manner, such as additionally guided raisable chain belts, which are linked with balances 255, 255*a*, such that both balances can independently of one another weigh the filling product quantity. Both filling device 90 and filling device 290 can be used for the complete filling of the containers associated therewith. As the filling of two containers takes place simultaneously with filling devices 90, 290, it is necessary that for and during the filling process the containers are jointly raised from conveyor belt 20, so that independently of the filling process the conveyor belt can be moved on, so that the containers can be transferred into the other work stations and reference will be made hereto hereinafter.

Filling apparatus 10*b* according to FIGS. 12 and 13 functions as follows. The containers associated with the individual work stations or filling devices and empty spaces 500, 510 are designated B1, B2, B3, B4, B5 and B6. Initially container B1 enters filling apparatus 10*b* and comes to rest below the first work station 50, where container B1 is aligned, the screw plug is unscrewed from its fill opening by means of plug unscrewing device 60, the container fill opening is engaged by the bunghole seeking device 70 and then the liquid measuring probe 80 is introduced into the container interior and then removed again. The thus prepared container B1 is then conveyed to the following empty space 500 and assumes there its position as container B2, while simultaneously another container enters filling apparatus 10*b* which remains below the first work station 50, so as to be treated in the same way as the preceding container which is now is position B2. The two containers B1, B2 are still not filled in the position shown in FIG. 13. The two containers B1, B2 are then jointly advanced until they are below filling device 90, 290 of the second work station 250. The containers then assume the positions at B3, B4 showing in FIG. 13. Both containers B3, B4 are simultaneously raised for the filling process. Conveyor belt 20 is then further advanced in single cycle manner, so that a new empty container is supplied to work station 50 and then the container from which the screw plug has been removed is moved into the empty space 500. Simultaneously a further container enters work station 50, so that once again there are two prepared, empty containers B1, B2 in the positions shown in FIG. 13. When the two containers B3, B4 have been filled, they are jointly lowered on to the conveyor belt and advanced to such an extent that containers B3, B4 assume the position shown in FIG. 13 of containers B5, B6, container B6 being located in the vicinity of the third work station 350, the scrw plus is screwed down by means of the plug screw-in device 360 and then the safety cap is fitted by means of device 370. Container B6 is sealed, while the container B5 is as yet unsealed. Simultaneously during the joint advance of the two filled containers B3, B4 into container position B5, B6, the two containers B1, B2 pass into the filling position below the two filling devices 90, 290 and assume position B3, B4 shown in FIG. 13. For the purposes of the filling process, the two containers in the vicinity of the filling devices 90, 290 must be raised again, while the conveyor belt 20 advances by one cycle, so that the still unsealed, but filled container B5 is moved into the vicinity of work station 350, where it is sealed. During the advance of container B5 into position B6, the sealed and filled container B6 is discharged from the filling apparatus 10*b* . The following container B5 is then sealed in work position 350 and the safety cap is mounted thereon. Conveyor belt 20 then runs in single cycle and partly in double cycle manner, in order to ensure a continuous filling process.

What is claimed is:

1. An apparatus for pouring a flowable medium into containers, particularly drums, having bungholes sealed with screw plugs or otherwise constructed plugs, the screw plugs preferably being covered with fitted safety caps; each container having a laterally projecting edge, an outer wall surface, a base plate with an outer circumferential rim, wherein the filling apparatus is arranged in a machine frame, comprising:

(a) a horizontal conveyor belt for moving the containers along a forward path and having a length at least twice the diameter of a container, said conveyor having a feed end, the conveyor belt comprising two spaced endless chain belts drive in a revolving manner and having upper sides which guide the containers, said belt having a container entrance region and a container discharge region.

(b) lifting means for raising the individual containers from the chain belts arranged on the feed end of the conveyor belt between the upper sides of the two chain belts, said lifting means comprising (b1) a hydraulically, pneumatically or electromotively driven raisable and lowerable lifting frame engaging the individual containers on their circumferential laterally projecting edges in the region between the two chain belts, (b2) at least three container supporting and c ing pulleys arranged in raisable and lowerable manner together with the lifting frame between the upper sides of the two chain belts on a circular line with a diameter at least corresponding to the container diameter and with bearing axes or spindles running radially to a vertical substantially central axis about which the container can rotate, the supporting and centering pulleys being freely displaceable along their bearing axes and being automatically centering towards the center of the circular line, so that a container standing on the supporting and centering pulleys is horizontally displaceable in all directions and (b3) three alignment pulleys having vertical bearing axes or spindles and arranged in the circumferential region of the container and standing on the supporting and centering pulleys and engageable on the container outer wall surface, or on the circumferential rim of a container base plate, a drive mechanism for driving at least one of said alignment pulleys being driven in rotary manner, one of said alignment pulleys simultaneously serving as a fixed, lateral boundary stop for the container, while the two other alignment pulleys facing said first alignment pulley being overhung on their bearing spindles, at least one of said three alignment pulleys being swingable out of its container outer wall surface engagement position, (c) a first work station having plug unscrewing means unscrewing the screw plugs, a bunghole seeking device, and centering means having a centering moisture measuring probe or with a centering device, the first work station comprising (c1) a horizontal mounting plate above the conveyor belt at a distance above the same at least corresponding to the heights of the container and which roughly extends over the length of said conveyor belt, below which is arranged a scanning mechanism for detecting the screw plugs of an entering empty container and which is constructed as a proximity switch, photoelectric element or the like and which is used for controlling the alignment pulleys for centering each empty container on the devices of the work station arranged above the container belt and (c2) a rotary disk rotatable on the mounting plate in a container entry region about a vertical axis by means of a drive mechanism, a central, vertical support connection or vertical guides on the rotary disk for supporting the plug unscrewing means, said support connection or vertical guides having guide slides, the bunghole seeking device and the moisture measuring probe in an angular position with respect to one another by means of naturally projecting radially directed arms fixed on the guide slides in such a way as to be vertically displaceable, an opening in the mounting plate facing the bunghole of the container and located centrally with respect to the forward path of the containers, (d) a second work station having a filling device with a filling connection movable in the vertical direction and swingable into a container bunghole and arranged on the mounting plate such that the filling connection of the filling device is centrally arranged in the container forward path and with a [illegible] conveyor belt, the filling device and balance facing one another and following the first work station and the mounting plate is provided with an opening for the passage of the filling connection, (e) a third work station with a plug screw-in device and with a device for receiving and mounting safety caps on the screw plugs screwed into a container bunghole, the third work station comprises a rotary disk rotatable by means of a drive mechanism about a vertical axis in the container discharge region and having a central vertical support connection or vertical guides on the rotary disk for supporting the plug screw-in device and safety cap mounting device, said supporting connections or vertical guides having guide slides and being vertically displaceably arranged in an angular position with respect to one another by means of laterally projecting, radially directed arms fixed to the guide slides, the mounting plate in its region facing the container discharge region and centrally with respect to the container feedpath having an opening for the passage of the plug screw-in device, the third work station being located after the second work station along the path of the containers, (f) a plug conveyor belt running parallel to the container conveyor belt having a plug feed end located in a pivoting region of the plug unscrewing device of the first work station and a plug discharge end in the pivoting region of the plug screw-in device of the third work station and (g) parallel to the container conveyor belt and preferably as an extension of the plug conveyor belt is provided a conveyor belt for the supply of safety caps to the device for receiving and mounting said safety caps of the third work station, whereby after aligning the empty container which has entered the filling device with its screw plug of the screw-in device of the first work station which is in the screw plug unscrewing position, the same is lowered on to the screw plug, removes the screw plug, raises the screw plug from the container filling opening and places it on the screw plug conveyor belt, puts the bunghole seeking device into operation and inserts the moisture measuring probe in the container interior and removes it therefrom, then supplies the empty container to the second work station, is filled here by means of the filling device, then the filled container is supplied to the third work station, in which the screw plug removed from the screw plug conveyor belt by means of the plug screw-in device is brought into a plug screw-in position by pivoting the screwing device and is screwed on to the container bunghole and the screw cap removed from the conveyor belt is placed on the screwed down screw plug by means of the screw-in device.

2. An apparatus according to claim 1, wherein the conveyor belt for the containers has a length corresponding to four times the diameter of a container and wherein the second work station comprises successively arranged first and second filling devices and two successively arranged balances in the vicinity of the conveyor belt, a balance being associated with each filling device, the first filling device being arranged for effecting a rough filling and the second filling device a fine filling until the desired filling state is reached.

3. An apparatus as in claim 2, wherein said moisture measuring probe has a circumference and free end, the moisture measuring probe carries a recentering pin for container recentering purposes on the probe circumference at a distance from the free end, said pin extending conically towards the free end of the probe and fill opening engages in the container at the fill opening, the alignment pulleys being disengaged from the container rim, so that the container is displaceable and aligned on the supporting and centering pulleys by means of the recentering pin.

4. An apparatus as in claim 2, wherein a recentering pin is provided in place of the moisture measuring probe on the rotary disk and is movable in the vertical direction by means of a drive mechanism.

5. An apparatus as in claim 2, wherein the first work station includes a supporting column, which is passed through the interior of the support connection and through the opening in the rotary disk fixed to the mounting plate, the support column being led out of the support connection of the rotary disk with a portion which carries the filling device.

6. A means according to claim 1, wherein the length of the conveyor belt for the containers corresponds to six times the diameter of a container and wherein the second work station between comprises successively arranged first and second filling devices and two successively arranged balances in the vicinity of the conveyor belt, one of said balances being associated with each filling device and wherein between the first filling device and the first work station and between the second filling device and the work third station has an empty space having the length of one container diameter, the containers in the second work station being raised from the conveyor belt, while other containers are supplied to the work stations or are moved into the empty spaces.

7. An apparatus as in claim 6, wherein said moisture measuring probe has a circumference and free end, the moisture measuring probe carries a recentering pin for container recentering purposes on the probe circumference at a distance from the free end, said pin extending conically toward the free end of the probe and fill opening engages in the container at the fill opening, the alignment pulleys being disengaged from the container rim, so that the container is displaceable and aligned on the supporting and centering pulleys by means of the recentering pin.

8. An apparatus as in claim 6, wherein a recentering pin is provided in place of the moisture measuring probe on the rotary disk and is movable in the vertical direction by means of a drive mechanism.

9. An apparatus as in claim 6, wherein the first work station includes a supporting column, which is passed through the interior of the support connection and through the opening in the rotary disk fixed to the mounting plate, the support column being led out of the support connection of the rotary disk with a portion which carries the filling device.

10. An apparatus according to claim 1, wherein said moisture measuring probe has a circumference and a free end, the moisture measuring probe carries a recentering pin for container recentering purposes on the probe circumference at a distance from the free end, said pin extending conically towards the free end of the probe and fill opening engages in the container at the fill opening, the alignment pulleys being disengaged from the container rim, so that the container is displaceable and aligned on the supporting and centering pulleys by means of the recentering pin.

11. An apparatus as in claim 10, wherein the first work station includes a supporting column, which is passed through the interior of the support connection and through the opening in the rotary disk fixed to the mounting plate, the support column being led out of the support connection of the rotary disk with a portion which carries the filling device.

12. An apparatus according to claim 1, wherein recentering pin is provided in place of the moisture measuring probe on the rotary disk and is movable in the vertical direction by means of a drive mechanism.

13. An apparatus as in claim 12, wherein the first work station includes a supporting column, which is passed through the interior of the support connection and through the opening in the rotary disk fixed to the mounting plate, the support column being led out of the support connection of the rotary disk with a portion which carries the filling device.

14. An apparatus according to claim 1, wherein the first work station includes a supporting column, which is passed through the interior of the support connection and through the opening in the rotary disk fixed to the mounting plate, the support column being led out of the support connection of the rotary disk with a portion which carries the filling device.

15. An apparatus as in claim 10, wherein a recentering pin is provided in place of the moisture probe on the rotary disk and is movable in the vertical direction by means of a drive mechanism.

* * * * *